US010565948B2

(12) United States Patent
Zhang et al.

(10) Patent No.: US 10,565,948 B2
(45) Date of Patent: Feb. 18, 2020

(54) DRIVING METHOD OF LIQUID CRYSTAL DISPLAY PANEL AND VOLTAGE ADJUSTMENT CIRCUIT

(71) Applicant: Shenzhen China Star Optoelectronics Semiconductor Display Technology Co., Ltd., Shenzhen (CN)

(72) Inventors: Xianming Zhang, Shenzhen (CN); Dan Cao, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 25 days.

(21) Appl. No.: 15/575,367

(22) PCT Filed: Aug. 29, 2017

(86) PCT No.: PCT/CN2017/099379
§ 371 (c)(1),
(2) Date: Nov. 19, 2017

(87) PCT Pub. No.: WO2019/024157
PCT Pub. Date: Feb. 7, 2019

(65) Prior Publication Data

US 2019/0043436 A1 Feb. 7, 2019

(30) Foreign Application Priority Data

Aug. 3, 2017 (CN) ..... 201710654983.4

(51) Int. Cl.
*G09G 3/36* (2006.01)

(52) U.S. Cl.
CPC ... *G09G 3/3648* (2013.01); *G09G 2320/0233* (2013.01); *G09G 2330/02* (2013.01)

(58) Field of Classification Search
CPC ..... G09G 3/3648–38
See application file for complete search history.

(56) References Cited

U.S. PATENT DOCUMENTS

2007/0164954 A1* 7/2007 Yang ..... G09G 3/3677 345/88
2015/0022512 A1* 1/2015 Ahn ..... G09G 3/3607 345/212

* cited by examiner

*Primary Examiner* — Hang Lin
(74) *Attorney, Agent, or Firm* — Mark M. Friedman

(57) ABSTRACT

A driving method of an LCD panel includes: obtaining an adjustable supply voltage and a predetermined voltage, calculating a first difference between the adjustable supply voltage and the predetermined voltage when the adjustable supply voltage is greater than the predetermined voltage, determining whether the first difference is greater than a reference voltage, and lowering the adjustable supply voltage when the first difference is greater than the reference voltage.

20 Claims, 2 Drawing Sheets

DRIVING METHOD OF LIQUID CRYSTAL DISPLAY PANEL AND VOLTAGE ADJUSTMENT CIRCUIT

BACKGROUND

1. Field of the Disclosure

The present disclosure relates to the field of display technology, and more particularly, to a driving method of a liquid crystal display (LCD) panel and a voltage adjustment circuit.

2. Description of Related Art

When an LCD panel is driven, a power adjustable supply voltage VSS serving as a low level voltage is supplied to a gate of a thin-film transistor (TFT) to turn off it, so that data electric charge can be well stored in the LCD panel to maintain normal display. Such an application can be done well to gate driver on array (GOA) items and non-GOA items.

Generally, the power supply voltage VSS voltage is supplied by a driving control circuit. The driving control circuit is usually arranged under the panel. With the increasing size of the panel, the load is increasing, and voltage loses as well. In addition, the distance between the panel and the driving control circuit increases, and the degree of interference gets greater as well, which makes the panel show errors and the leakage current in the panel becomes greater. As a result, the phenomenon of uneven display brightness in normal operation occurs, which deteriorates the display effect.

Therefore, it is necessary to provide a display method of an LCD panel and a voltage adjustment circuit to solve the technical problem of the related art.

SUMMARY

An object of the present disclosure is to propose a display method of a liquid crystal display (LCD) panel and a voltage adjustment circuit. With the display method and the voltage adjustment circuit, the display brightness of the LCD panel is more uniform, which enhances the display effect.

According to one aspect of the present disclosure, a voltage adjustment circuit is configured to adjust an adjustable supply voltage of a liquid crystal display (LCD) panel. The LCD panel comprises three or more areas. The three or more areas comprise a predetermined area and two or more adjustment areas. A distance between the predetermined area and a driving circuit equals to a predetermined distance. The driving circuit is configured to supply a supply voltage. The voltage adjustment circuit comprises an obtaining circuit, a first determining circuit, a first calculating circuit, a second determining circuit and a first adjustment circuit. The obtaining circuit is configured to obtain an adjustable supply voltage that is a supply voltage applied on the adjustable supply voltage and a predetermined voltage that is a supply voltage applied on the predetermined voltage. The first determining circuit is configured to determine whether the adjustable supply voltage is greater than the predetermined voltage. The first calculating circuit is configured to calculate a first difference between the adjustable supply voltage and the predetermined voltage when the adjustable supply voltage is greater than the predetermined voltage. The second determining circuit is configured to determine whether the first difference is greater than a reference voltage. The first adjustment circuit is configured to lower the adjustable supply voltage when the first difference is determined to be greater than the reference voltage with the second determining circuit. The voltage adjustment circuit further comprises a second calculating circuit, a third determining circuit and a second adjustment circuit. The second calculating circuit is configured to calculate a second difference between the predetermined voltage and the adjustable supply voltage when the adjustable supply voltage is less than the predetermined voltage. The third determining circuit is configured to determine whether the second difference is greater than a reference voltage. The second adjustment circuit is configured to increase the adjustable supply voltage when the second difference is greater than the reference voltage. The voltage adjustment circuit further comprises a control circuit. The first adjustment circuit is configured to generate a first adjustment signal when the first difference is greater than the reference voltage. The control circuit is configured to lower the adjustable supply voltage when the first adjustment signal is fed to the control circuit.

Furthermore, the voltage adjustment circuit further comprises a control circuit. The second adjustment circuit is configured to generate a second adjustment signal when the second difference is greater than the reference voltage. The control circuit is configured to increase the adjustable supply voltage when the second adjustment signal is fed to the control circuit.

Furthermore, the second adjustment signal is at a high voltage level when the second difference is greater than the reference voltage.

Furthermore, the first determining circuit comprises a third voltage comparator. The second calculating circuit comprises a second subtractor and a second switch. The third determining circuit comprises a fourth voltage comparator. The second subtractor comprises a first input terminal receiving the predetermined voltage. The first subtractor comprises a second input terminal receiving the adjustable supply voltage. The third voltage comparator comprises a positive input terminal receiving the predetermined voltage, a negative input terminal receiving the adjustable supply voltage, and an output terminal connected to a control terminal of the second switch. The second switch comprises an input terminal connected to an output terminal of the second subtractor and an output terminal connected a positive input terminal of the fourth voltage comparator. The reference voltage is received through a negative input terminal of the fourth voltage comparator. The second control signal is output through an output terminal of the fourth voltage comparator.

Furthermore, the first determining circuit comprises a first voltage comparator. The first calculating circuit comprises a first subtractor and a first switch. The second determining circuit comprises a second voltage comparator. The first subtractor comprises a first input terminal receiving the adjustable supply voltage and a second input terminal receiving the predetermined voltage. The adjustable supply voltage is received through a positive input terminal of the first voltage comparator. The predetermined voltage is received through a negative input terminal of the first voltage comparator; the first voltage comparator comprises an output terminal connected to a control terminal of the first switch. The first switch comprises an input terminal connected to an output terminal of the first subtractor. The first switch comprises an output terminal connected to a positive input terminal of the second voltage comparator. The reference voltage is received through a negative input terminal of the second voltage comparator. An output terminal of the second voltage comparator outputs a first control signal.

Furthermore, the first adjustment signal is at a high voltage level when the first difference is greater than the reference voltage.

Furthermore, the LCD panel comprises three areas. The three areas are a predetermined area, a first adjustment area, and a second adjustment area. A second distance is greater than a first distance; the first distance is greater than the predetermined distance. The first distance is a distance between the first adjustment area and the driving circuit. The second distance is a distance between the second adjustment area and the driving circuit.

According to another aspect of the present disclosure, a driving method of a liquid crystal display (LCD) panel comprises: dividing the LCD panel comprising three or more areas comprising a predetermined area and two or more adjustment areas, wherein a predetermined distance equals to a distance between the predetermined area and a driving circuit that is configured to supply a supply voltage; obtaining an adjustable supply voltage and a predetermined voltage wherein the adjustable supply voltage is a supply voltage applied on the adjustment area, and the predetermined voltage is the supply voltage applied on the predetermined area; determining whether the adjustable supply voltage is greater than the predetermined voltage; calculating a first difference between the adjustable supply voltage and the predetermined voltage when the adjustable supply voltage is greater than the predetermined voltage; determining whether the first difference is greater than a reference voltage; and lowering the adjustable supply voltage when the first difference is greater than the reference voltage.

Furthermore, the driving method further comprises: calculating a second difference between the predetermined voltage and the adjustable supply voltage when the adjustable supply voltage is less than the predetermined voltage, determining whether the second difference is greater than the reference voltage, and increasing the adjustable supply voltage when the second difference is greater than the reference voltage.

Furthermore, the increasing the adjustable supply voltage when the second difference is greater than the reference voltage comprises: generating a second adjustment signal, and inputting the second adjustment signal to a control circuit to trigger the control circuit to increase the adjustable supply voltage.

Furthermore, the lowering the adjustable supply voltage when the first difference is greater than the reference voltage comprises: generating a first adjustment signal, and inputting the first adjustment signal to a control circuit to trigger the control circuit to lower the adjustable supply voltage.

According to still another aspect of the present disclosure, a voltage adjustment circuit is configured to adjust an adjustable supply voltage of a liquid crystal display (LCD) panel. The LCD panel comprises three or more areas. The three or more areas comprise a predetermined area and two or more adjustment areas. A distance between the predetermined area and a driving circuit equals to a predetermined distance. The driving circuit is configured to supply a supply voltage. The voltage adjustment circuit comprises an obtaining circuit, a first determining circuit, a first calculating circuit, a second determining circuit and a first adjustment circuit. The obtaining circuit is configured to obtain an adjustable supply voltage that is a supply voltage applied on the adjustable supply voltage and a predetermined voltage that is a supply voltage applied on the predetermined voltage. The first determining circuit is configured to determine whether the adjustable supply voltage is greater than the predetermined voltage. The first calculating circuit is configured to calculate a first difference between the adjustable supply voltage and the predetermined voltage when the adjustable supply voltage is greater than the predetermined voltage. The second determining circuit is configured to determine whether the first difference is greater than a reference voltage. The first adjustment circuit is configured to lower the adjustable supply voltage when the first difference is determined to be greater than the reference voltage with the second determining circuit.

Furthermore, the voltage adjustment circuit further comprises a second calculating circuit, a third determining circuit and a second adjustment circuit. The second calculating circuit is configured to calculate a second difference between the predetermined voltage and the adjustable supply voltage when the adjustable supply voltage is less than the predetermined voltage. The third determining circuit is configured to determine whether the second difference is greater than a reference voltage. The second adjustment circuit is configured to increase the adjustable supply voltage when the second difference is greater than the reference voltage.

Furthermore, the voltage adjustment circuit further comprises a control circuit. The second adjustment circuit is configured to generate a second adjustment signal when the second difference is greater than the reference voltage. The control circuit is configured to increase the adjustable supply voltage when the second adjustment signal is fed to the control circuit.

Furthermore, the second adjustment signal is at a high voltage level when the second difference is greater than the reference voltage.

Furthermore, the first determining circuit comprises a third voltage comparator. The second calculating circuit comprises a second subtractor and a second switch. The third determining circuit comprises a fourth voltage comparator. The second subtractor comprises a first input terminal receiving the predetermined voltage. The first subtractor comprises a second input terminal receiving the adjustable supply voltage. The third voltage comparator comprises a positive input terminal receiving the predetermined voltage, a negative input terminal receiving the adjustable supply voltage, and an output terminal connected to a control terminal of the second switch. The second switch comprises an input terminal connected to an output terminal of the second subtractor and an output terminal connected a positive input terminal of the fourth voltage comparator. The reference voltage is received through a negative input terminal of the fourth voltage comparator. The second control signal is output through an output terminal of the fourth voltage comparator.

Furthermore, the first determining circuit comprises a first voltage comparator. The first calculating circuit comprises a first subtractor and a first switch. The second determining circuit comprises a second voltage comparator. The first subtractor comprises a first input terminal receiving the adjustable supply voltage and a second input terminal receiving the predetermined voltage. The adjustable supply voltage is received through a positive input terminal of the first voltage comparator. The predetermined voltage is received through a negative input terminal of the first voltage comparator; the first voltage comparator comprises an output terminal connected to a control terminal of the first switch. The first switch comprises an input terminal connected to an output terminal of the first subtractor. The first switch comprises an output terminal connected to a positive input terminal of the second voltage comparator. The reference voltage is received through a negative input terminal of the second voltage comparator. An output terminal of the second voltage comparator outputs a first control signal.

Furthermore, the voltage adjustment circuit further comprises a control circuit. The first adjustment circuit is configured to generate a first adjustment signal when the first difference is greater than the reference voltage. The control circuit is configured to lower the adjustable supply voltage when the first adjustment signal is fed to the control circuit.

Furthermore, the first adjustment signal is at a high voltage level when the first difference is greater than the reference voltage.

Furthermore, the LCD panel comprises three areas. The three areas are a predetermined area, a first adjustment area, and a second adjustment area. A second distance is greater than a first distance; the first distance is greater than the predetermined distance. The first distance is a distance between the first adjustment area and the driving circuit. The second distance is a distance between the second adjustment area and the driving circuit.

With respect to the display method of the LCD panel and the voltage adjustment circuit proposed by the present disclosure, the supply voltage applied on an area which is a little far away from the driving circuit is adjusted. The adjustment of the supply voltage makes the supply voltage applied on each area keep consistent, thereby making the display brightness more uniform, which enhances the display effect.

DETAILED DESCRIPTION OF THE EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

A driving method of a liquid crystal display (LCD) panel is proposed according to an embodiment of the present disclosure. The driving method includes following blocks S101-S109.

At block S101, an LCD panel is divided into three or more areas.

Figure 1:
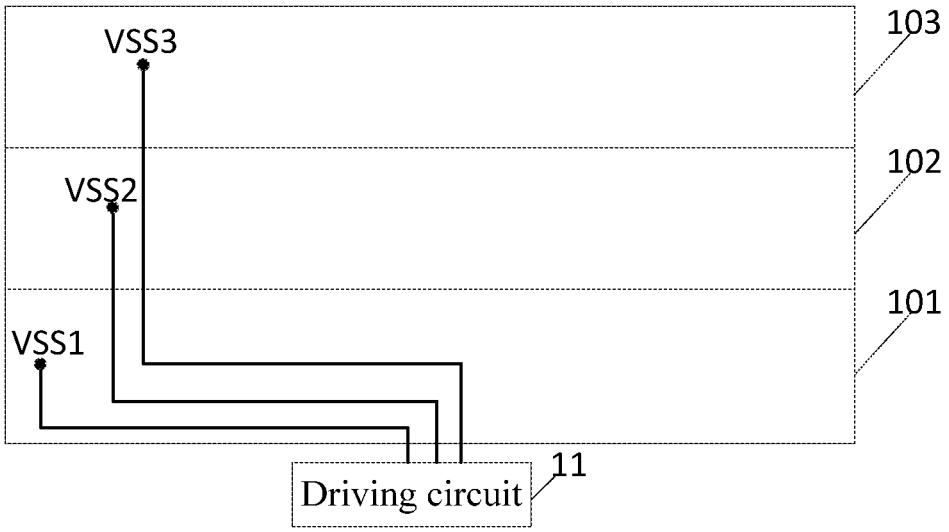
FIG. 1 illustrates a schematic diagram of a liquid crystal display panel according to a preferred embodiment of the present disclosure.

As FIG. 1 illustrates, the LCD panel proposed by the present disclosure is divided into three areas 101-103. The three areas 101-103 include a predetermined area 101, a first adjustment area 102, and a second adjustment area 103.

A distance between the predetermined area 101 and the driving circuit 11 equals to a predetermined distance. The predetermined area 101 is the nearest area to the driving circuit 11, and the adjustment areas are areas far away from the driving circuit 11. The distance between the first adjustment area 102 and the driving circuit 11 is set as a first distance. The distance between the second adjustment area 103 and the driving circuit 11 is set as a second distance. The second distance is greater than the first distance. The first distance is greater than the predetermined distance. In other words, the distance between the predetermined area 101 and the driving circuit 11, the distance between the first adjustment area 102 and the driving circuit 11, and the distance between the second adjustment area 103 and the driving circuit 11 are gradually increasing.

The driving circuit 11 is configured to supply a supply voltage such as a low voltage level adjustable supply voltage VSS. The low voltage level adjustable supply voltage VSS is configured to turn off a thin-film transistor (TFT).

The LCD panel may be divided into three or more areas. The number of the area is not limited by the present disclosure.

At block S102, an adjustable supply voltage and a predetermined voltage are obtained.

For example, the supply voltage applied on the first adjustment area 102 and the supply voltage applied on the second adjustment area 103 are obtained. That is, two adjustable supply voltages VSS2 and VSS3 are obtained correspondingly. Further, the supply voltage applied on the predetermined area, i.e., a predetermined voltage VSS1, is obtained at the same time. In other words, the adjustable supply voltage is the supply voltage applied on the adjustment area, and the predetermined voltage is the supply voltage applied on the predetermined area.

At block S103, it is determined that whether the adjustable supply voltage is greater than the predetermined voltage or not.

For example, it is determined that whether each of the adjustable supply voltages is greater than the predetermined voltage. A voltage adjustment circuit may be arranged in each of the adjustment areas. The adjustable supply voltage applied on its corresponding area is determined whether to be greater than the predetermined voltage with a voltage comparator in the voltage adjustment circuit.

At block S104, a first difference between the adjustable supply voltage and the predetermined voltage is obtained when the adjustable supply voltage is greater than the predetermined voltage.

Take the second adjustment area 103 for example. The difference between the adjustable supply voltage VSS3 applied on the second adjustment area 103 and the adjustable supply voltage VSS1 applied on the predetermined area 101 is obtained when the adjustable supply voltage VSS3 is greater than the adjustable supply voltage VSS1. The difference is V1, for example.

At block S105, the first difference is determined to be greater than a reference voltage.

For example, the difference V1 is determined with the voltage comparator whether to be greater than a reference voltage Vref.

At block S106, the adjustable supply voltage is lowered when the first difference is greater than the reference voltage.

It demonstrates that the difference between the adjustable supply voltage VSS3 applied on the second adjustment area 103 and the adjustable supply voltage VSS1 applied on the predetermined area 101 exceeds a predetermined range when the difference V1 is greater than the reference voltage Vref. That is, the adjustable supply voltage VSS3 is too great. The brightness of the second adjustment area 103 is different from the brightness of the predetermined area 101 when the difference between the adjustable supply voltage VSS3 applied on the second adjustment area 103 and the adjustable supply voltage VSS1 applied on the predetermined area 101 exceeds the predetermined range so the adjustable supply voltage is lowered at this time so that the brightness of the second adjustment area 103 can be the same as the brightness of the predetermined area 101.

Block S106 of lowering the adjustable supply voltage includes block S1061 and block S1062.

At block S1061, a first adjustment signal is generated when the first difference is greater than the reference voltage.

At block S1062, the first adjustment signal is input to a control circuit to trigger the control circuit to lower the adjustable supply voltage.

The first adjustment signal is generated when the difference V1 is greater than the reference voltage Vref. Afterwards, the first adjustment signal is input to the control circuit 27 to trigger the control circuit 27 to adjust the adjustable supply voltage VSS3 to a lesser extent. The control circuit 27 may be a timing controller. Specifically the code inside a pulse width modulation (PMW) integrated circuit (IC) is altered to adjust the adjustable supply voltage VSS3.

At block S107, a second difference between the predetermined voltage and the adjustable supply voltage is obtained when the adjustable supply voltage is less than the predetermined voltage.

Take the second adjustment area 103 for example. The difference between the adjustable supply voltage VSS3 applied on the second adjustment area 103 and the adjustable supply voltage VSS1 applied on the predetermined area 101 is obtained when the adjustable supply voltage VSS3 is less than the adjustable supply voltage VSS1. The difference is V3, for example.

At block S108, it is determined that whether the second difference is greater than the reference voltage.

Another voltage comparator is used to compare the difference V3 and the reference voltage Vref.

At block S109, the adjustable supply voltage increases when the second difference is greater than the reference voltage.

For example, it demonstrates that the difference between the adjustable supply voltage VSS1 applied on the predetermined area 101 and the adjustable supply voltage VSS3 applied on the second adjustment area 103 exceeds the predetermined range when the difference V3 is greater than the reference voltage Vref. That is, the adjustable supply voltage VSS3 is too small so the adjustable supply voltage increases.

Block S109 of increasing the adjustable supply voltage includes block S1091 and block S1092.

At block S1091, a second adjustment signal is generated when the second difference is greater than the reference voltage.

At block S1092, the second adjustment signal is input to the control circuit to trigger the control circuit to increase the adjustable supply voltage.

For example, the second adjustment signal is generated when the difference V3 is greater than the reference voltage Vref. Afterwards, the second adjustment signal is input to the control circuit 27 to trigger the control circuit 27 to increase the adjustable supply voltage. The method of adjusting the supply voltage of the first adjustment area 102 is the same as the method of adjusting the supply voltage of the second adjustment area 103 so the latter will not be detailed.

Figure 2:
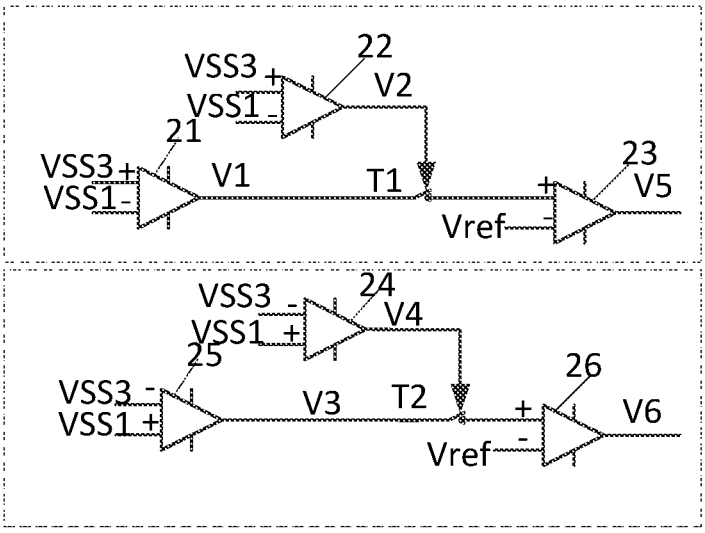
FIG. 2 illustrates a circuit diagram of a voltage adjustment circuit according to one embodiment of the present disclosure.

Refer to FIG. 1 and FIG. 2. The present disclosure also proposes a voltage adjustment circuit. The circuit adjustment circuit is configured to adjust adjustable supply voltages applied on the adjustment areas in the LCD panel. The LCD panel includes three areas. The three areas are a predetermined area 101, a first adjustment area 102, and a second adjustment area 103. The predetermined area 101 is the area of the distance between the predetermined area 101 and a driving circuit 11. The predetermined area 101 is equal to the area of a predetermined distance. The adjustable supply voltages are supply voltages applied on the first adjustment area 102 and second adjustment area 103. A predetermined voltage is a supply voltage applied on the predetermined area 101.

The voltage adjustment circuit includes an obtaining circuit, a first determining circuit, a first calculating circuit, a second determining circuit, a first adjustment circuit, a second calculating circuit, a third determining circuit and a second adjustment circuit.

The obtaining circuit, e.g. a timing controller TCON, is configured to obtain an adjustable supply voltage that is a supply voltage applied on the adjustable supply voltage and a predetermined voltage that is a supply voltage applied on the predetermined voltage.

The first determining circuit is configured to determine whether the adjustable supply voltage is greater than the predetermined voltage.

The first calculating circuit is configured to calculate a first difference between the adjustable supply voltage and the predetermined voltage when the adjustable supply voltage is greater than the predetermined voltage.

The second determining circuit is configured to determine whether the first difference is greater than a reference voltage.

The first adjustment circuit is configured to lower the adjustable supply voltage when the first difference is determined to be greater than the reference voltage with the second determining circuit.

The second calculating circuit is configured to calculate a second difference between the predetermined voltage and the adjustable supply voltage when the adjustable supply voltage is less than the predetermined voltage.

The third determining circuit is configured to determine whether the second difference is greater than a reference voltage.

The second adjustment circuit is configured to increase the adjustable supply voltage when the second difference is greater than the reference voltage.

Figure 3:
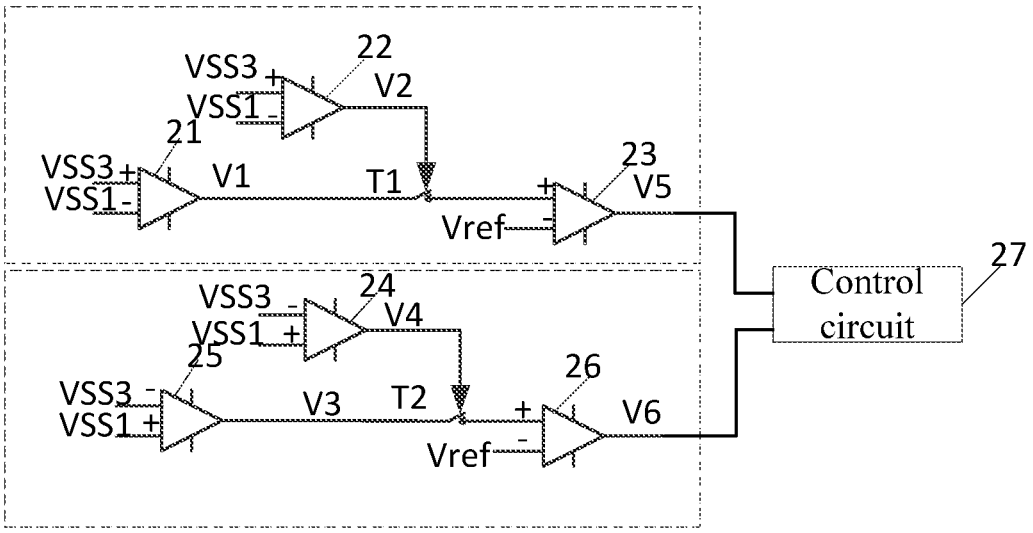
FIG. 3 illustrates a circuit diagram of a voltage adjustment circuit according to another embodiment of the present disclosure.

Referring to FIG. 3, the voltage adjustment circuit further comprises a control circuit 27.

The first adjustment circuit is configured to generate a first adjustment signal when the first difference is greater than the reference voltage. The control circuit 27 is configured to lower the adjustable supply voltage when the first adjustment signal is fed to the control circuit.

Furthermore, the second adjustment circuit is configured to generate a second adjustment signal when the second difference is greater than the reference voltage. The control circuit 27 is configured to increase the adjustable supply voltage when the second adjustment signal is fed to the control circuit 27.

Take the second adjustment area 103 for example. As FIG. 3 illustrates, a first determining circuit includes a first voltage comparator 22. The first calculating circuit includes a first subtractor 21 and a first switch T1. A second determining circuit includes the second voltage comparator 23.

The first subtractor 21 includes a first input terminal (i.e., positive input terminal) receiving the adjustable supply voltage VSS3 and a second input terminal (i.e., negative input terminal) receiving the predetermined voltage VSS1.

The adjustable supply voltage VSS3 is received through the positive input terminal of the first voltage comparator 22. The predetermined voltage VSS1 is received through the negative input terminal of the first voltage comparator 22. The first voltage comparator 22 includes an output terminal connected to a control terminal of the first switch T1.

An input terminal of the first switch T1 is connected to an output terminal of the first subtractor 21. An output terminal of the first switch T1 is connected to a positive input terminal of the second voltage comparator 23. The reference voltage Vref is received through a negative input terminal of the second voltage comparator 23. An output terminal of the second voltage comparator 23 outputs a first control signal.

The first determining circuit further includes a third voltage comparator 24. The second calculating circuit includes a second subtractor 25 and a second switch T2. A third determining circuit includes a fourth voltage comparator 26.

The second subtractor 25 includes a first input terminal (i.e., positive input terminal) receiving the predetermined voltage VSS1 and a second input terminal (i.e., negative input terminal) receiving the adjustable supply voltage VSS3.

The third voltage comparator 24 includes a positive input terminal receiving the predetermined voltage VSS1, a negative input terminal receiving the adjustable supply voltage VSS3, and an output terminal connected to a control terminal of the second switch T2.

An input terminal of the second switch T2 is connected to an output terminal of the second subtractor 25. An output terminal of the second switch T2 is connected a positive input terminal of the fourth voltage comparator 26. The reference voltage Vref is received through a negative input terminal of the fourth voltage comparator 26. The second control signal is output through the output terminal of the fourth voltage comparator 26.

When the second difference is greater than the reference voltage, the second adjustment signal is at a high voltage level and the adjustable supply voltage increases.

When the adjustable supply voltage VSS3 is greater than the predetermined voltage VSS1, a voltage V2 output by the first voltage comparator 22 is at a high voltage level, and the first switch T1 is turned on at this time. The voltage V1 output by the first subtractor 21 is the difference between the adjustable supply voltage VSS3 and the predetermined voltage VSS1. Compared with the voltage V1 and the reference voltage Vref, it demonstrates that the difference is too great and exceeds a predetermined range and that the adjustable supply voltage VSS3 is too great with the premise that a voltage V5 output by the second voltage comparator 23 is at a high voltage level. Therefore, the adjustable supply voltage VSS3 is lowered. When the voltage V5 is at a low voltage level, it demonstrates that the difference is within the predetermined range so the display effect is not affected. Therefore, it is unnecessary to adjust the adjustable supply voltage VSS3.

When the first difference is greater than the reference voltage, the first adjustment signal is at a high voltage level and the adjustable supply voltage is adjusted to a lesser.

When the adjustable supply voltage VSS3 is less than the predetermined voltage VSS1, a voltage V4 output by the third voltage comparator 24 is at a high voltage level, and the second switch T2 is turned on at this time. The voltage V3 output by the second subtractor 25 is the difference between the predetermined voltage VSS1 and the adjustable supply voltage VSS3. Compared with the voltage V3 and the reference voltage Vref, it demonstrates that the difference is too great and exceeds the predetermined range and that the adjustable supply voltage VSS3 is too small with the premise that a voltage V6 output by the fourth voltage comparator 26 is at a high voltage level. Therefore, the adjustable supply voltage VSS3 increases. When the voltage V6 is at a low voltage level, it demonstrates that the difference is within the predetermined range so the display effect is not affected. Therefore, it is unnecessary to adjust the adjustable supply voltage VSS3.

After the above-mentioned adjustment, the difference between the supply voltage applied on the area which is a little far away from the driving circuit and the predetermined voltage is within the predetermined range. In other words, the supply voltage applied on each of the areas is nearly the same, thereby making the display brightness more uniform, which enhances the display effect.

With respect to the display method of the LCD panel and the voltage adjustment circuit proposed by the present disclosure, the supply voltage applied on an area which is a little far away from the driving circuit is adjusted. The adjustment of the supply voltage makes the supply voltage applied on each area keep consistent, thereby making the display brightness more uniform, which enhances the display effect.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A voltage adjustment circuit, configured to adjust an adjustable supply voltage of a liquid crystal display (LCD) panel; the LCD panel comprising three or more areas; the three or more areas comprising a predetermined area and two or more adjustment areas; wherein a distance between the predetermined area and a driving circuit equals to a predetermined distance; the driving circuit is configured to supply a supply voltage; the voltage adjustment circuit comprises:

an obtaining circuit, configured to obtain an adjustable supply voltage and a predetermined voltage wherein the adjustable supply voltage is a supply voltage applied on the adjustment area, and the predetermined voltage is the supply voltage applied on the predetermined area;

a first determining circuit, configured to determine whether the adjustable supply voltage is greater than the predetermined voltage;

a first calculating circuit, configured to calculate a first difference between the adjustable supply voltage and the predetermined voltage when the adjustable supply voltage is greater than the predetermined voltage;

a second determining circuit, configured to determine whether the first difference is greater than a reference voltage;

a first adjustment circuit, configured to lower the adjustable supply voltage when the first difference is determined to be greater than the reference voltage with the second determining circuit;

a second calculating circuit, configured to calculate a second difference between the predetermined voltage and the adjustable supply voltage when the adjustable supply voltage is less than the predetermined voltage;

a third determining circuit, configured to determine whether the second difference is greater than a reference voltage;

a second adjustment circuit, configured to increase the adjustable supply voltage when the second difference is greater than the reference voltage;

wherein the voltage adjustment circuit further comprises a control circuit;

the first adjustment circuit is configured to generate a first adjustment signal when the first difference is greater than the reference voltage; the control circuit is configured to lower the adjustable supply voltage when the first adjustment signal is fed to the control circuit.

2. The voltage adjustment circuit of claim 1, wherein the second adjustment circuit is configured to generate a second adjustment signal when the second difference is greater than the reference voltage; the control circuit is configured to increase the adjustable supply voltage when the second adjustment signal is fed to the control circuit.

3. The voltage adjustment circuit of claim 2, wherein the second adjustment signal is at a high voltage level when the second difference is greater than the reference voltage.

4. The voltage adjustment circuit of claim 1, wherein the first determining circuit comprises a third voltage comparator; the second calculating circuit comprises a second subtractor and a second switch; the third determining circuit comprises a fourth voltage comparator;

the second subtractor comprises a first input terminal receiving the predetermined voltage; the first subtractor comprises a second input terminal receiving the adjustable supply voltage;

the third voltage comparator comprises a positive input terminal receiving the predetermined voltage, a negative input terminal receiving the adjustable supply voltage, and an output terminal connected to a control terminal of the second switch;

the second switch comprises an input terminal connected to an output terminal of the second subtractor and an output terminal connected a positive input terminal of the fourth voltage comparator; the reference voltage is received through a negative input terminal of the fourth voltage comparator; the second control signal is output through an output terminal of the fourth voltage comparator.

5. The voltage adjustment circuit of claim 1, wherein the first determining circuit comprises a first voltage comparator; the first calculating circuit comprises a first subtractor and a first switch; the second determining circuit comprises a second voltage comparator;

the first subtractor comprises a first input terminal receiving the adjustable supply voltage and a second input terminal receiving the predetermined voltage;

the adjustable supply voltage is received through a positive input terminal of the first voltage comparator; the predetermined voltage is received through a negative input terminal of the first voltage comparator; the first voltage comparator comprises an output terminal connected to a control terminal of the first switch;

the first switch comprises an input terminal connected to an output terminal of the first subtractor; the first switch comprises an output terminal connected to a positive input terminal of the second voltage comparator; the reference voltage is received through a negative input terminal of the second voltage comparator; an output terminal of the second voltage comparator outputs a first control signal.

6. The voltage adjustment circuit of claim 1, wherein the first adjustment signal is at a high voltage level when the first difference is greater than the reference voltage.

7. The voltage adjustment circuit of claim 1, wherein the LCD panel comprises three areas; the three areas are a predetermined area, a first adjustment area, and a second adjustment area; a second distance is greater than a first distance; the first distance is greater than the predetermined distance;

the first distance is a distance between the first adjustment area and the driving circuit; the second distance is a distance between the second adjustment area and the driving circuit.

8. A driving method of a liquid crystal display (LCD) panel, comprising:

dividing the LCD panel comprising three or more areas comprising a predetermined area and two or more adjustment areas, wherein a predetermined distance equals to a distance between the predetermined area and a driving circuit that is configured to supply a supply voltage;

obtaining an adjustable supply voltage and a predetermined voltage wherein the adjustable supply voltage is a supply voltage applied on the adjustment area, and the predetermined voltage is the supply voltage applied on the predetermined area;

determining whether the adjustable supply voltage is greater than the predetermined voltage;

calculating a first difference between the adjustable supply voltage and the predetermined voltage when the adjustable supply voltage is greater than the predetermined voltage;

determining whether the first difference is greater than a reference voltage; and lowering the adjustable supply voltage when the first difference is greater than the reference voltage.

9. The driving method of claim 8, further comprising:

calculating a second difference between the predetermined voltage and the adjustable supply voltage when the adjustable supply voltage is less than the predetermined voltage;

determining whether the second difference is greater than the reference voltage;

increasing the adjustable supply voltage when the second difference is greater than the reference voltage.

10. The driving method of claim 9, wherein the increasing the adjustable supply voltage when the second difference is greater than the reference voltage comprises:

generating a second adjustment signal;

inputting the second adjustment signal to a control circuit to trigger the control circuit to increase the adjustable supply voltage.

11. The driving method of claim 8, wherein the lowering the adjustable supply voltage when the first difference is greater than the reference voltage comprises:

generating a first adjustment signal;

inputting the first adjustment signal to a control circuit to trigger the control circuit to lower the adjustable supply voltage.

12. A voltage adjustment circuit, configured to adjust an adjustable supply voltage of a liquid crystal display (LCD) panel; the LCD panel comprising three or more areas; the three or more areas comprising a predetermined area and two or more adjustment areas; wherein a distance between the predetermined area and a driving circuit equals to a predetermined distance; the driving circuit is configured to supply a supply voltage; the voltage adjustment circuit comprises:

an obtaining circuit, configured to obtain an adjustable supply voltage and a predetermined voltage wherein the adjustable supply voltage is a supply voltage applied on the adjustment area, and the predetermined voltage is the supply voltage applied on the predetermined area;

a first determining circuit, configured to determine whether the adjustable supply voltage is greater than the predetermined voltage;

a first calculating circuit, configured to calculate a first difference between the adjustable supply voltage and the predetermined voltage when the adjustable supply voltage is greater than the predetermined voltage;

a second determining circuit, configured to determine whether the first difference is greater than a reference voltage; and a first adjustment circuit, configured to lower the adjustable supply voltage when the first difference is determined to be greater than the reference voltage with the second determining circuit.

13. The voltage adjustment circuit of claim 12, further comprising:

a second calculating circuit, configured to calculate a second difference between the predetermined voltage and the adjustable supply voltage when the adjustable supply voltage is less than the predetermined voltage;

a third determining circuit, configured to determine whether the second difference is greater than a reference voltage; and a second adjustment circuit, configured to increase the adjustable supply voltage when the second difference is greater than the reference voltage.

14. The voltage adjustment circuit of claim 13, further comprising a control circuit, wherein the second adjustment circuit is configured to generate a second adjustment signal when the second difference is greater than the reference voltage; the control circuit is configured to increase the adjustable supply voltage when the second adjustment signal is fed to the control circuit.

15. The voltage adjustment circuit of claim 14, wherein the second adjustment signal is at a high voltage level when the second difference is greater than the reference voltage.

16. The voltage adjustment circuit of claim 13, wherein the first determining circuit comprises a third voltage comparator; the second calculating circuit comprises a second subtractor and a second switch; the third determining circuit comprises a fourth voltage comparator;

the second subtractor comprises a first input terminal receiving the predetermined voltage; the first subtractor comprises a second input terminal receiving the adjustable supply voltage;

the third voltage comparator comprises a positive input terminal receiving the predetermined voltage, a negative input terminal receiving the adjustable supply voltage, and an output terminal connected to a control terminal of the second switch;

the second switch comprises an input terminal connected to an output terminal of the second subtractor and an output terminal connected a positive input terminal of the fourth voltage comparator; the reference voltage is received through a negative input terminal of the fourth voltage comparator; the second control signal is output through an output terminal of the fourth voltage comparator.

17. The voltage adjustment circuit of claim 12, wherein the first determining circuit comprises a first voltage comparator; the first calculating circuit comprises a first subtractor and a first switch; the second determining circuit comprises a second voltage comparator;

the first subtractor comprises a first input terminal receiving the adjustable supply voltage and a second input terminal receiving the predetermined voltage;

the adjustable supply voltage is received through a positive input terminal of the first voltage comparator; the predetermined voltage is received through a negative input terminal of the first voltage comparator; the first voltage comparator comprises an output terminal connected to a control terminal of the first switch;

the first switch comprises an input terminal connected to an output terminal of the first subtractor; the first switch comprises an output terminal connected to a positive input terminal of the second voltage comparator; the reference voltage is received through a negative input terminal of the second voltage comparator; an output terminal of the second voltage comparator outputs a first control signal.

18. The voltage adjustment circuit of claim 12, wherein the voltage adjustment circuit further comprises a control circuit;

the first adjustment circuit is configured to generate a first adjustment signal when the first difference is greater than the reference voltage; the control circuit is configured to lower the adjustable supply voltage when the first adjustment signal is fed to the control circuit.

19. The voltage adjustment circuit of claim 18, wherein the first adjustment signal is at a high voltage level when the first difference is greater than the reference voltage.

20. The voltage adjustment circuit of claim 12, wherein the LCD panel comprises three areas; the three areas are a predetermined area, a first adjustment area, and a second adjustment area; a second distance is greater than a first distance; the first distance is greater than the predetermined distance;

the first distance is a distance between the first adjustment area and the driving circuit; the second distance is a distance between the second adjustment area and the driving circuit.

* * * * *